US005402316A

United States Patent [19]

Volz et al.

[11] Patent Number: 5,402,316

[45] Date of Patent: Mar. 28, 1995

[54] COMPUTER DOCKING STATIONS AND DEVICES SLIDABLY INSERTED THEREIN

[75] Inventors: Keith L. Volz, Jamestown; Frederick R. Deak, Kernersville; Robert M. Renn, Pfafftown; Robert D. Irlbeck, Greensboro; David C. Johnson; Warren A. Bates, both of Winston-Salem, all of N.C.

[73] Assignee: The Whitaker Corporation, Wilmington, Del.

[21] Appl. No.: 56,522

[22] Filed: Apr. 28, 1993

[51] Int. Cl.[6] ..... H01R 23/68

[52] U.S. Cl. ..... 361/785; 439/59

[58] Field of Search ..... 439/59–62, 439/49–50, 43–44, 65, 75; 361/749, 752, 760, 761, 807, 808, 809, 810, 784–787

[56] References Cited

U.S. PATENT DOCUMENTS

| | | | |
|---|---|---|---|
| 3,858,957 | 1/1975 | Harwood et al. | 439/59 |
| 5,040,991 | 8/1991 | Collier | 439/60 |
| 5,239,748 | 8/1993 | Hamilton | 439/60 |

*Primary Examiner*—Bot Ledynh

[57] ABSTRACT

A docking station (10) slidably receives a device (12) to provide make, break or tap functions, respectively, in a circuit interface. The circuit interface includes a pair of connector housings (17, 18) provided with flexible (or compressible) electrical connectors (19, 20), respectively. A camming member (28, 29; 31, 32; 44) separates the connector housings (17, 18) as the device (12) is slidably inserted into the docking station (10), thereby assuring a substantially zero insertion force on the circuit interface. Preferably, the circuit interface is between the flexible electrical connectors (19, 20), a printed circuit board (13), and a flexible etched circuit (15). The flexible etched circuit (15) is provided with a stiffener (24) resiliently biased by springs (27).

14 Claims, 12 Drawing Sheets

COMPUTER DOCKING STATIONS AND DEVICES SLIDABLY INSERTED THEREIN

CROSS REFERENCE TO RELATED APPLICATION

The present invention is related to a pending application for United States Letters Patent, Ser. No. 07/995,474 filed Dec. 22, 1992, entitled "Electronic Apparatus Including A Pair Of Assemblies Having A Zero Insertion Force Therebetween", and assigned to the assignee of the present invention.

1. FIELD OF THE INVENTION

The present invention relates to computer docking stations (and/or docking connectors) and devices, such as memory cards, slidably inserted therein.

2. BACKGROUND OF TEE INVENTION

In the aforesaid prior application, there is disclosed and claimed a preferred embodiment of a computer docking system, including a docking station having an electrical member provided with at least one circuit element thereon. A device is slidably insertable into the docking station and has at least one circuit element thereon. A connector housing within the docking station has a flexible electrical connector providing a circuit interface between the circuit elements on the electrical member and the device, respectively. The device has at least one camming protrusion formed thereon, and the docking station has a camming surface engaging the camming protrusion as the device is slidably inserted into the docking station. Because of the camming action, the device is deflected relative to the connector housing in a direction which is substantially transverse to the direction in which the device is slidably inserted into the docking station, thereby assuring a substantially zero insertion force for the circuit interface, and thereby preserving the structural integrity and hence the reliability of the circuit interface within the docking station. Upon full insertion of the device, the camming protrusion is received in a recess means in the docking station.

SUMMARY OF TEE PRESENT INVENTION

In accordance with the teachings of the present invention, there is herein disclosed and claimed, a docking connector which includes a flexible etched circuit having at least one circuit element thereon, and further includes an electrical member (such as a printed circuit board) having at least one contact pad thereon. A pair of connector housings is disposed between the flexible etched circuit and the electrical member, including a first connector housing and a second connector housing. A first compressible electrical connector in the first connector housing engages the circuit element on the flexible film, and a second compressible electrical connector in the second connector housing engages the first compressible electrical connector and the circuit pad on the electrical member, respectively. A device is slidably inserted between the connector housings and has at least one circuit element thereon, thereby establishing a circuit interface having make and break and tap functions, respectively. A camming means is provided between the device and at least one of the connector housings, thereby separating the connector housings and hence the respective compressible electrical connectors therein relative to each other and in a direction substantially transverse to the direction in which the device is slidably inserted, and thereby assuring that the device is slidably inserted with a substantially zero insertion force on the circuit interface.

Preferably, the flexible etched circuit is backed up by a stiffener, and a spring means provides a resilient bias on the stiffener (and hence the first and second connector housings) in opposition to the force of the camming means.

In one embodiment, the camming means includes at least one camming bump on the device, and this camming bump extends both above and below the device. The connector housings have respective front faces provided with communicating inwardly-tapered surfaces engaging the camming bump on the device; and the connector housings further have respective communicating pockets to receive the camming bump on the device, such that the device is slidably inserted into the docking connector and received therein with a detented "snap" action.

In another embodiment, the camming bump includes a slip-on cam secured to the forward edge of the device and protruding forwardly therefrom. The slip-on cam has a dovetailed connection with the device, and the slip-on cam further has an externally-tapered forward surface engaging the inwardly-tapered surfaces on the respective front faces of the connector housings.

In yet another embodiment, the device is provided with a frame having a forward edge, and the camming bump is formed on the forward edge of the frame.

Preferably, a pair of spaced-apart camming bumps are provided for engaging a pair of spaced-apart inwardly-tapered surfaces on the connector housings, respectively; and the connector housings have a spaced-apart pair of communicating pockets receiving the respective camming bumps.

A protective cover may be slidably carried by the device. This protective cover includes a forward edge provided with a pair of blind slots, each of which has a bottom. As the device is further inserted into the docking connector, the forward edge of the cover engages the docking connector; and as the device is withdrawn from the docking connector, the camming bumps on the device ride within the respective blind slots in the protective cover and engage the respective bottoms thereof, thereby returning the protective cover to its original position on the device.

Viewed in another aspect, the present invention provides the following combination in a docking connector: A lower housing is secured on top of a printed circuit board. An upper housing is disposed on top of the lower housing, and means are provided for accurately aligning the upper and lower housings laterally with respect to each other. A stiffener is on top of the upper housing, and a flexible etched circuit is sandwiched between the stiffener and the top of the upper housing. A flexible electrical connector is disposed in each of the upper and lower housings and provides a circuit interface with the flexible etched circuit and the printed circuit board, respectively. A suitable fastening means retains the stiffener, the upper and lower housings, and the printed circuit board, respectively. A device (such as a memory card) is inserted between the upper and lower housings to provide a make and break and tap function with the circuit interface, respectively. This device is inserted with a zero insertion force.

These and other objects of the present invention will become apparent from a reading of the following specification taken in conjunction with the enclosed drawings.

BRIEF DESCRIPTION OF THE DRAWINGS

FIG. 3 is a front elevational view of the docking station with the device inserted therein.

FIG. 13 is an exploded perspective view of an alternate embodiment in which the camming bump on the device comprise respective slip-on cams secured to the forward edge of the device.

GENERAL DESCRIPTION OF THE PREFERRED EMBODIMENTS

Figure 1:
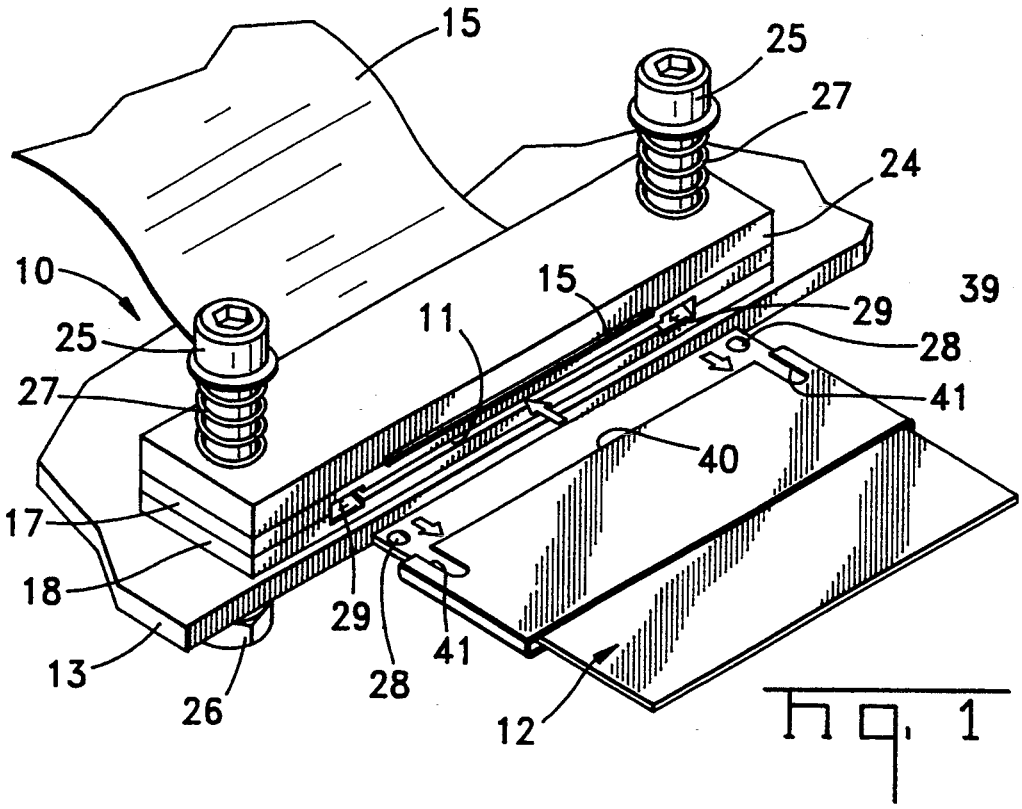
FIG. 1 is a perspective view of one embodiment of the present invention, showing a device (preferably provided with a protective cover) being slidably inserted within a computer docking station.
Figure 2:
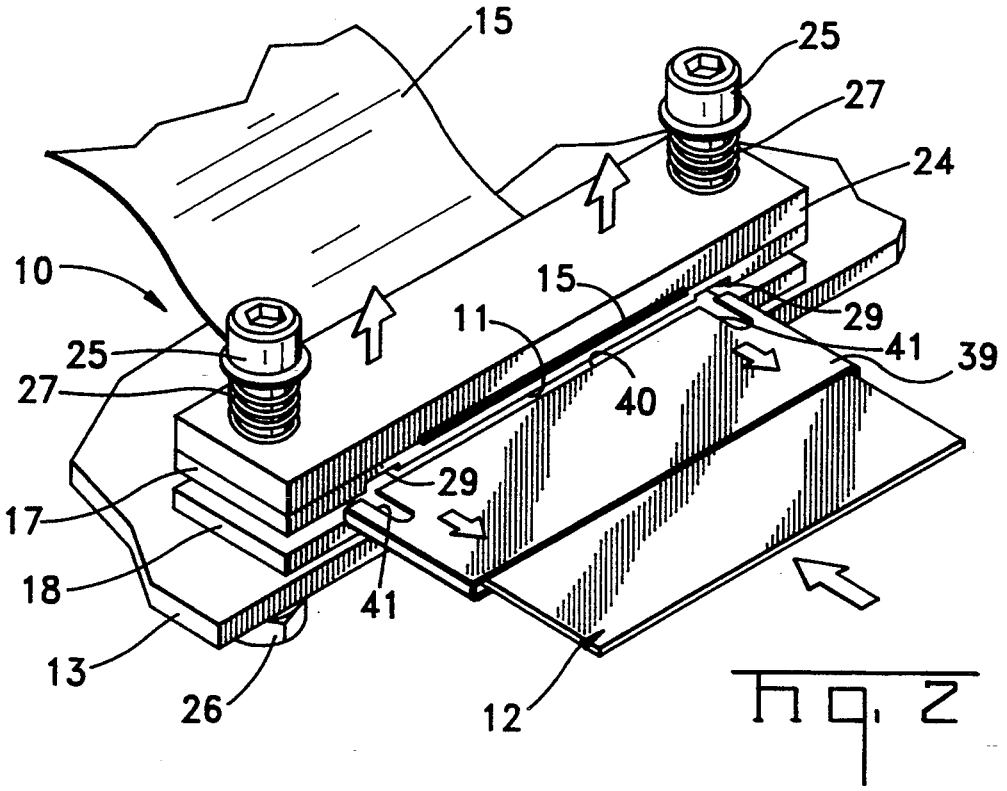
FIG. 2 is a further perspective view, corresponding substantially to FIG. 1, but showing the protective cover abutting against the docking station as the device is further inserted therein.

With reference to FIGS. 1–3, a computer docking station 10 has a slotted opening 11 for slidably receiving a device 12. By way of example only, the docking station 10 may be a personal computer ("PC") and the device 12 may be a memory card. It will be understood, however, that the teachings of the present invention are not confined thereto, but rather are equally applicable to a wide variety of apparatuses and devices used in computer products, systems and related technologies.

Figure 4:
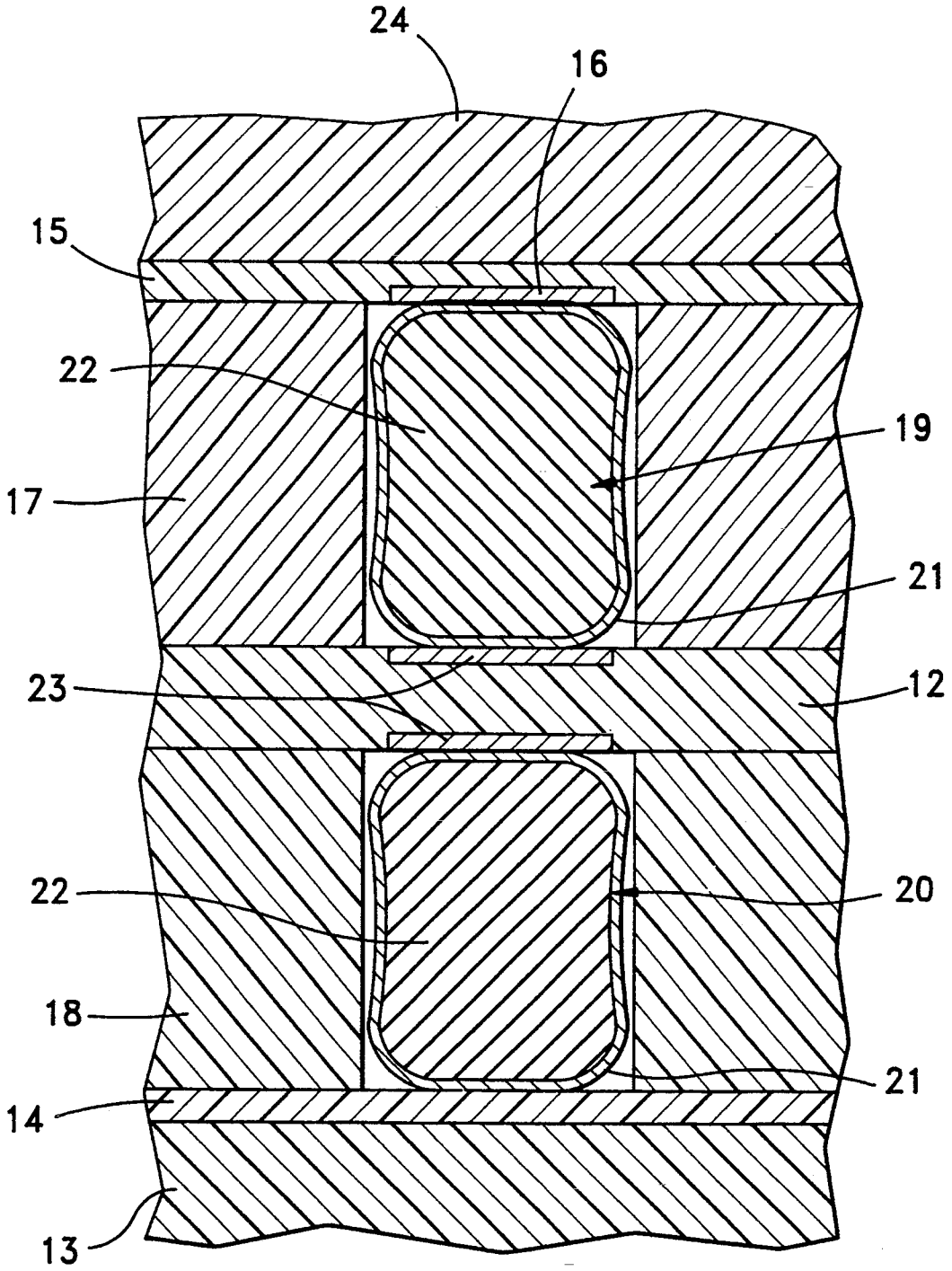
FIG. 4 is a cross-sectional view, taken along the lines 4—4 of FIG. 3 and drawn to an enlarged scale, and showing how the circuit traces on the respective flexible electrical connectors provide the desired circuit interface between the circuit elements on the device the printed circuit board, and the flexible etched circuit, respectively.

With this in mind, and with reference to FIG. 4, the docking station 10 includes a printed circuit board ("PCB") 13 having at least one circuit pad 14 thereon, and the docking station 10 further includes a flexible etched circuit 15 having at least one circuit element 16 thereon. A pair of connector housings including an upper housing 17 and a lower housing 18, respectively, are disposed between the printed circuit board 13 and the flexible etched circuit 15. A pair of flexible (or compressible) electrical connectors 19 and 20 are housed within the connector housings 17 and 18, respectively. These flexible electrical connectors 19 and 20 have respective finely-pitched circuit traces 21 carried by respective elastomeric cores 22, thereby providing the desired circuit interface as shown more clearly in FIG. 4. This circuit interface constitutes the circuit elements 16 on the flexible etched circuit 15, the circuit traces 21 on the flexible electrical connector 19, circuit elements 23 on the device 12, the circuit traces 21 on the flexible electrical connector 20, and the circuit pads 14 on the printed circuit board 13.

The circuit traces 21 on the flexible electrical connectors 19 and 20 may be formed from a gold-plated nickel-clad copper foil for superior conductivity. Typically, these traces 21 are three (3) mils wide with a seven (7) mils center-to-center spacing, such that the traces 21 have a four (4) mils spacing therebetween. A complete line of flexible electrical connectors is supplied by AMP Incorporated of Harrisburg, Pa. under its registered "AMPLIFLEX" trademark.

Any suitable fastening means may be provided for retaining the components of the docking station 10 and providing a desired resilient bias on the circuit interface. In a preferred embodiment, FIGS. 1–3, a stiffener 24 is provided for the side of the flexible etched circuit 15 (opposite to the connector housing 17) and a pair of threaded bolts 25 pass through the docking station 10 and carry respective nuts 26. A coil spring 27 is piloted on each bolt 25 for exerting the desired resilient bias on the stiffener 24 and hence the overall assembly (as hereinafter explained in detail).

Figure 7:
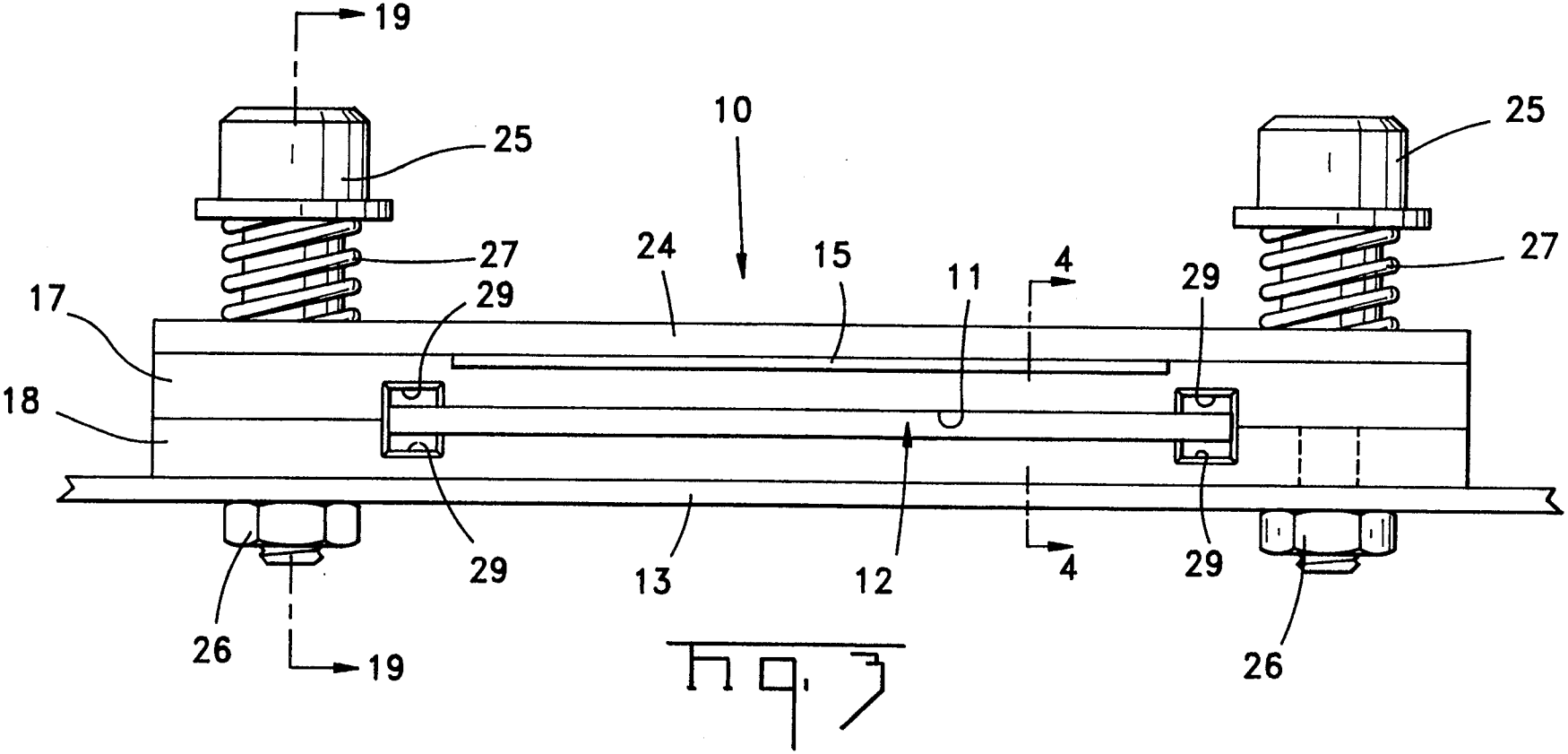
FIGS. 5–8 are sequential cross-sectional views showing the manner in which the device is slidably inserted into the docking station, thereby providing a substantially zero insertion force for the circuit interface within the docking station.
Figure 5:
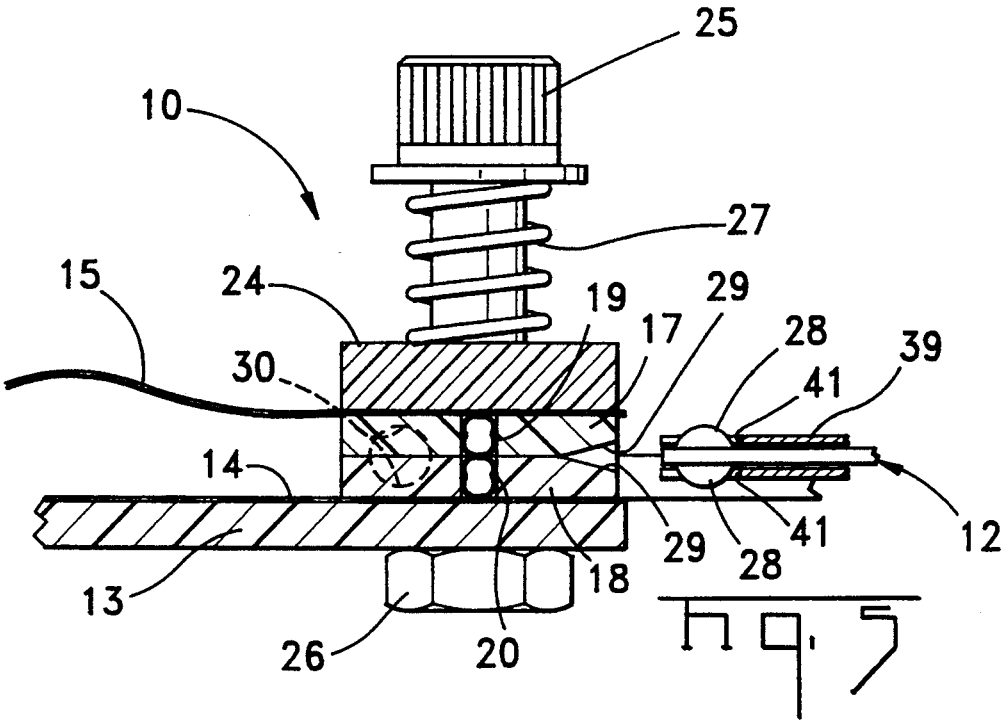
Figure 6:
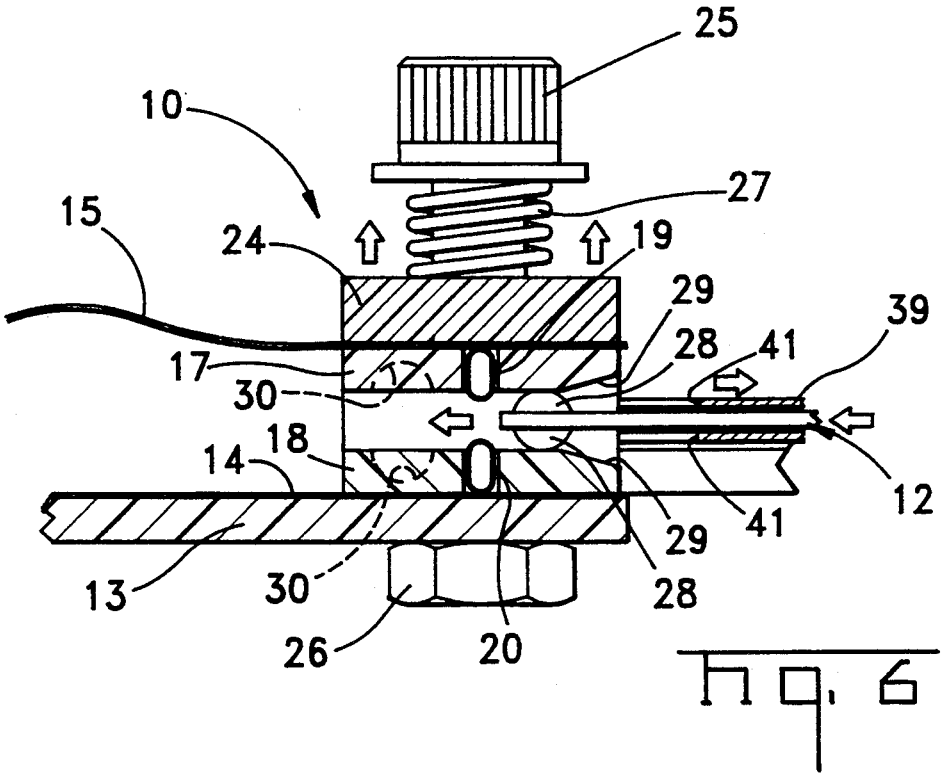
Figure 7:
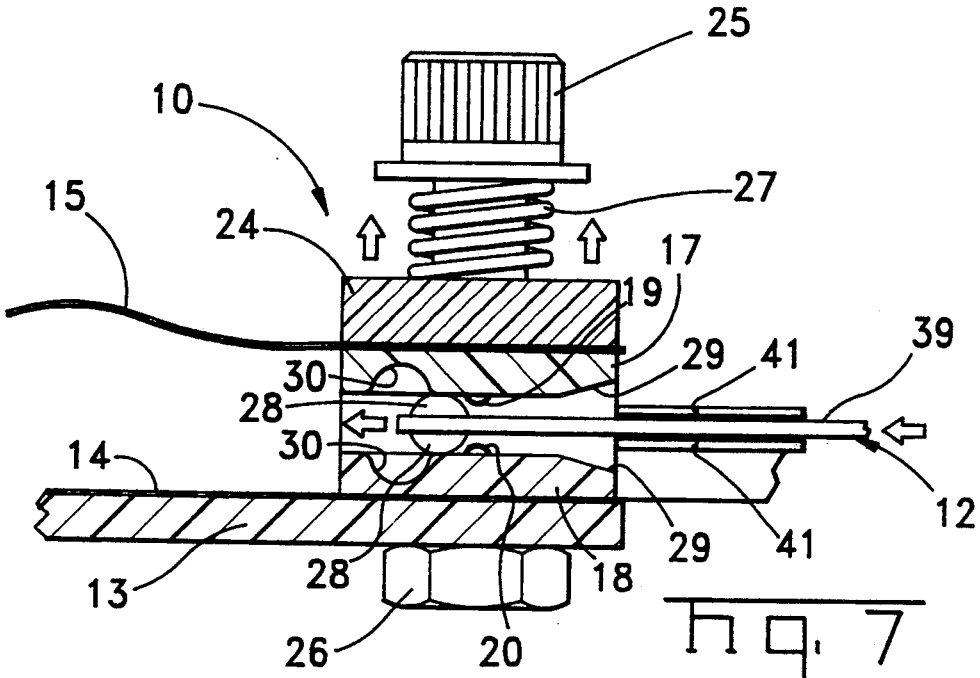

Any suitable camming means may be employed, consonant with the teachings of the present invention. As shown more clearly in FIGS. 5–8, the device 12 has a camming bump 28. Preferably, this camming bump 28 is substantially spherical and has respective portions extending above and below the device 12. As the device 12 is slidably inserted into the slotted opening 11 in the docking station 10, the camming bump 28 engages inwardly-tapered camming surfaces 29 formed on the respective connector housings 17 and 18 (FIG. 5). These camming surfaces 29 are formed at the opposite ends of the slotted opening 11, as shown more clearly in FIG. 3. As the device 12 is further inserted into the docking station 10, the respective connector housings 17 and 18 (and hence the respective flexible electrical connectors 19 and 20) are deflected away from each other (FIGS. 6 and 7) against the resilient bias of the springs 27 and in a direction which is substantially transverse to the direction in which the device 12 is slidably inserted into the docking station 10. As a result, the circuit elements 23 on the device 12 will not rub or scrape against the circuit traces 21 on the respective flexible electrical connector 19 and 20, so that the device 12 will be inserted into the docking station 10 with a substantially zero insertion force (or "ZIF") thereby preserving the structural integrity of the circuit interface. Thereafter, the camming bump 28 is received in cooperating complementary pockets 30 (FIG. 8) substantially with a "snap action" to provide a solid detented connection between the device 12 and the docking station 10. This detented connection may be manually overridden by simply pulling on the device 12 and slidably removing it from the docking station 10, in which case the camming bump 28 rides out of its pockets 30 to again separate the connector housings 17 and 18, respectively.

Figure 8:
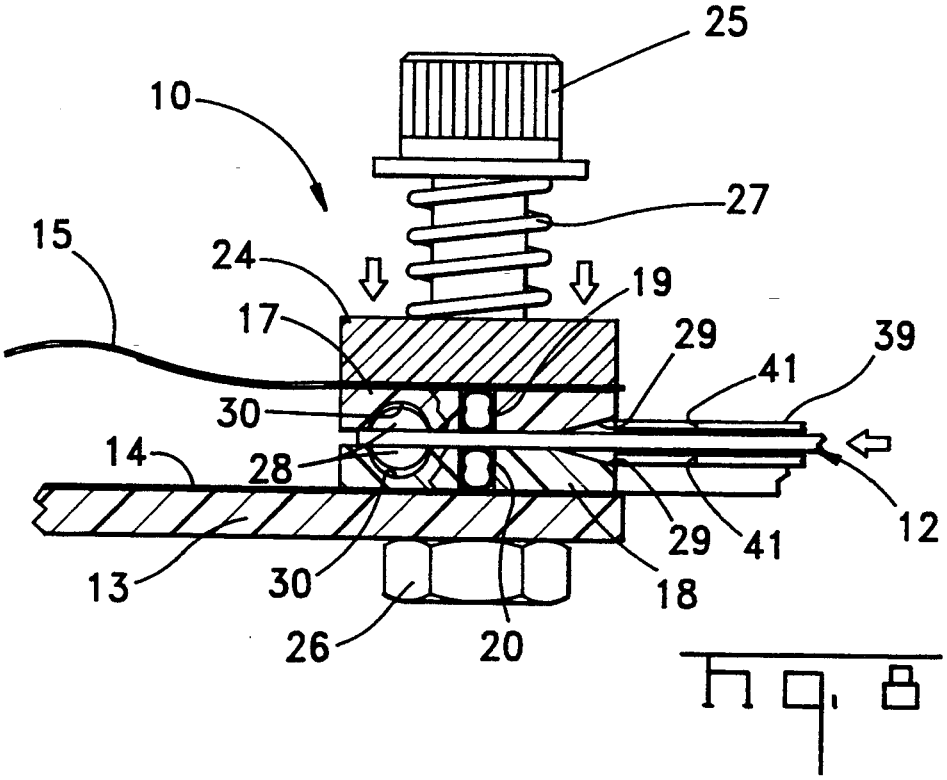
Figure 9:
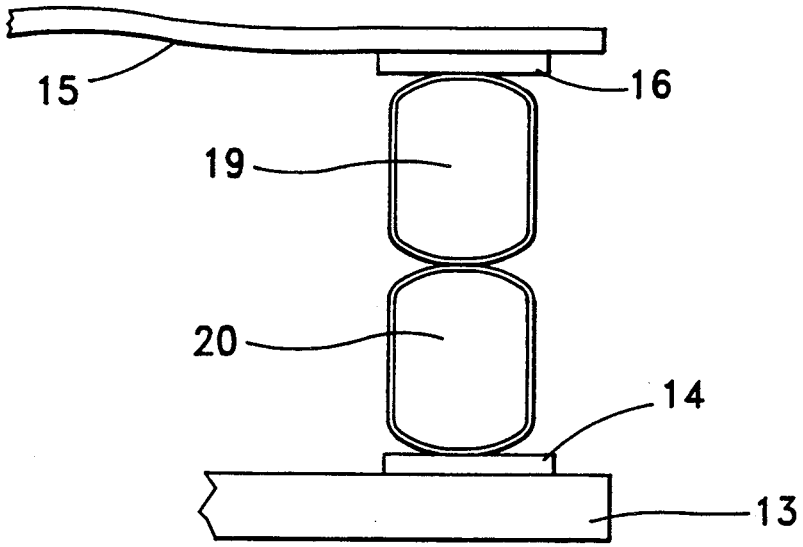
FIGS. 9–12 are schematic cross-sectional views, showing the circuit interface with the make and break and tap functions, respectively, on the circuit interface.
Figure 10:
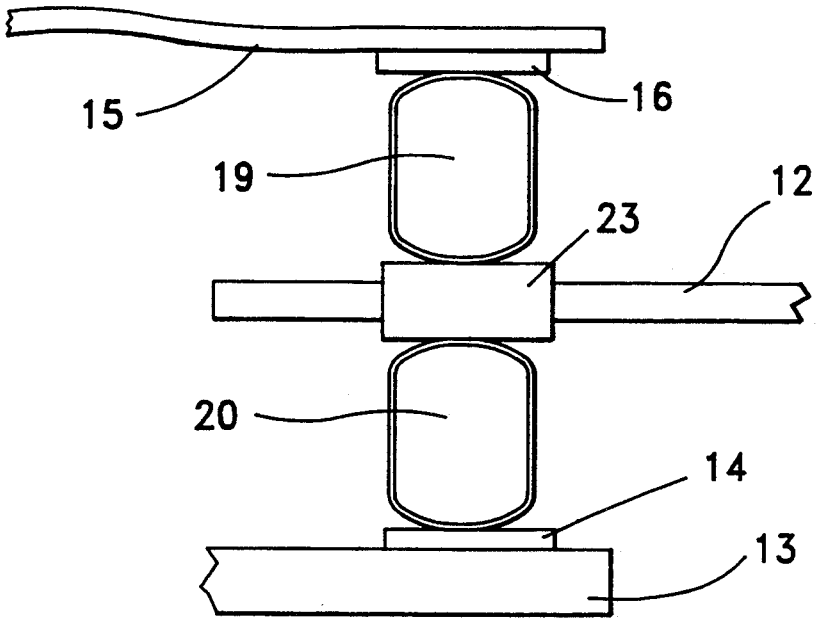
Figure 11:
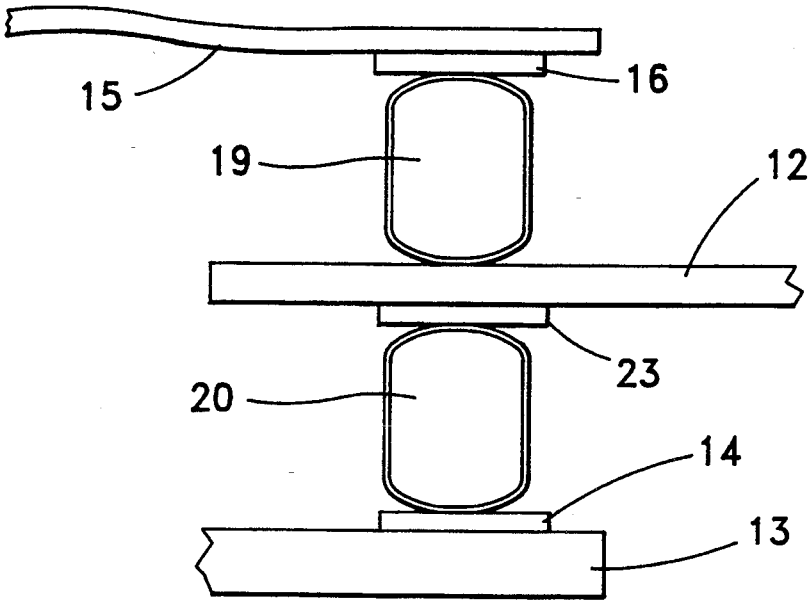
Figure 12:
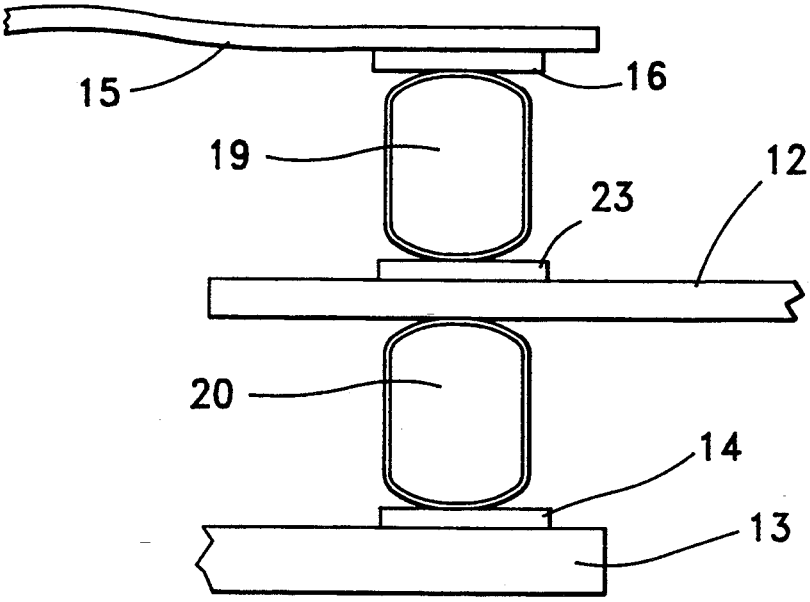

With this structural arrangement, and as shown schematically in FIGS. 9–12, a circuit interface is provided with make and break and tap functions, respectively, for product versatility. In FIG. 8, the device 12 has not been inserted, so that both of the flexible electrical connectors 19 and 20 are in the circuit. In FIGS. 10–12, on the other hand, the device 12 has been inserted between the flexible electrical connectors 19 and 20. In FIG. 10, the device 12 has a full connection with both of the flexible electrical connectors 19 and 20. In FIG. 11, the device 12 is connected only to the lower flexible electrical connector 20, and the upper flexible electrical connector 19 is disconnected. In FIG. 12, the opposite is the case, namely, the device 12 is connected only to the upper flexible electrical connector 19, and the lower flexible electrical connector 20 is out of the circuit. The flexibility and versatility provided by this make, break and tap arrangement is important in numerous computer products and systems, and the zero insertion force on the circuit interface assures product reliability.

An alternate embodiment of the camming means is shown in FIG. 13. There, the camming bumps 28 have been deleted and, in lieu thereof, a pair of spaced-apart slip-on cams 31 have been provided. Each of these slip-on cams 31 has an externally-tapered forward portion 32 (for engaging the inwardly-tapered camming surfaces 29) and further has a rearward portion 33 provided with a blind dovetailed opening 34. This dovetailed opening 34 receives a complementary dovetailed portion 35 formed on the forward edge 36 of the device 12. The slip-on cams 31 may be made of a suitable plastic material (such as a nylon derivative) which is sufficiently hard yet provides a bearing or gliding surface. Preferably, the slip-on cams 31 are slidably fitted on the device 12, endwise thereof, and are glued (or otherwise suitably secured) to the device 12.

Figure 17:
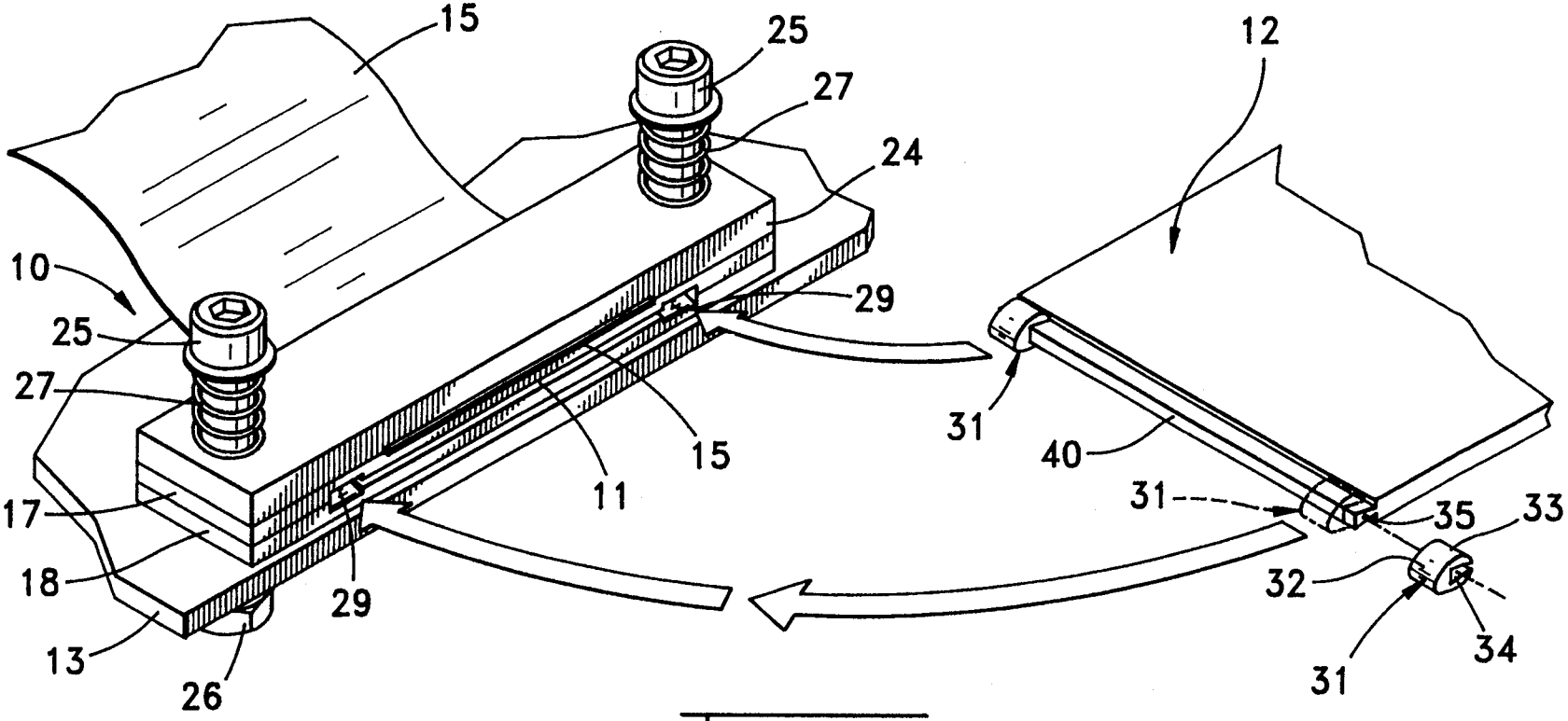
FIGS. 14–17 are cross-sectional views, showing the sequence for insertion of the device (with the slip-on cams) into the docking station to assure a substantially zero insertion force, thereby preserving the structural integrity of the circuit interface.
Figure 14:
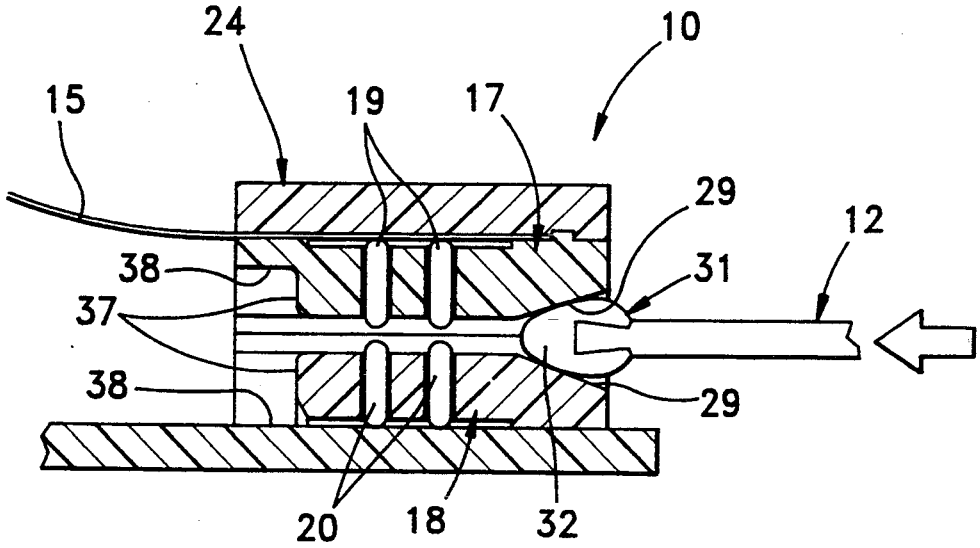
Figure 15:
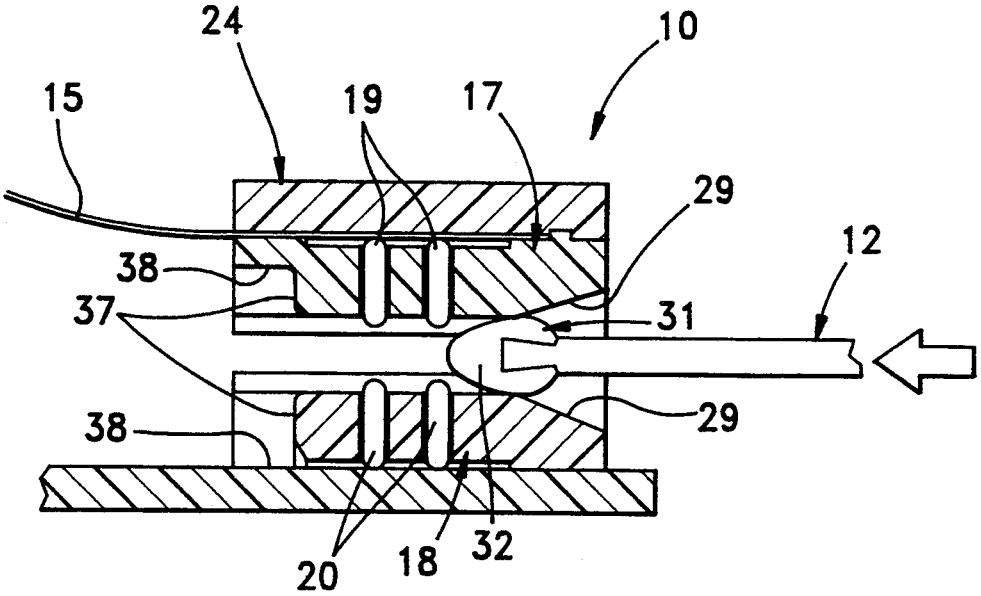
Figure 16:
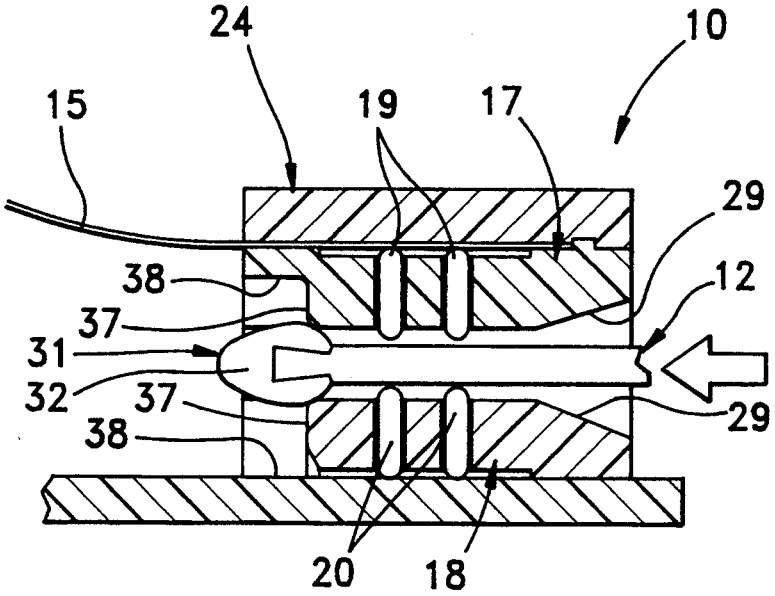
Figure 17:
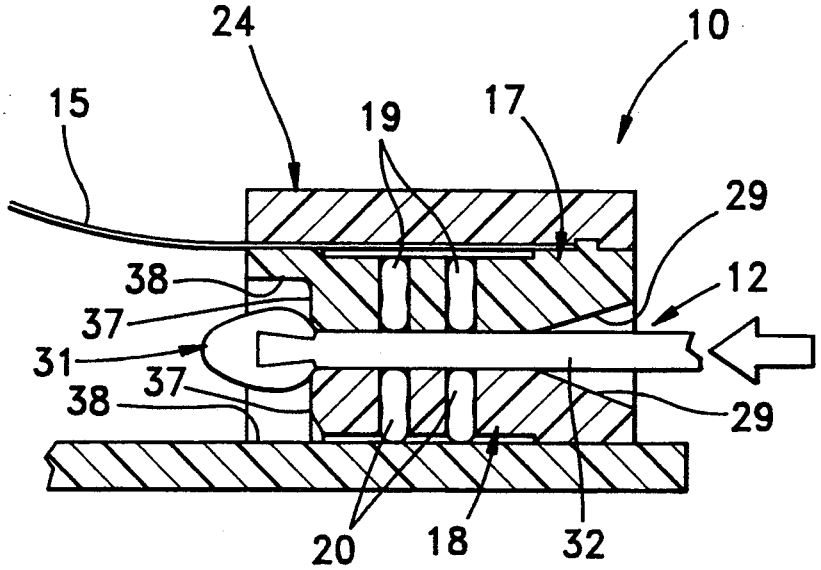

As shown in FIGS. 14–17, the operation of this alternate embodiment of the invention is substantially identical to that to FIGS. 5–9, respectively. As the device 12 is inserted into the docking station 10 (FIG. 14) the forward tapered portion 32 of the slip-on cam 31 engages the inwardly-tapered camming surfaces 29, separating the respective connector housings 17 and 18 (FIGS. 14 and 15) until the slip-on cam 31 clears respective shoulders 37 on recesses 38 formed rearwardly of the connector housings 17 and 18, respectively. Thereafter, the slip-on cam 31 is received within the recesses 38 with a detented "snap action", as shown in FIG. 17. When the device 12 is slidably removed from the docking station 10 (FIG. 16) the slip-on cam 31 rides out of the respective recesses 38 to again separate the respective connector housings 17 and 18, so that the removal of the device 12 out of the docking station is also with a substantially zero insertion force (or "ZIF").

With reference again to FIGS. 1 and 2, the device 12 is preferably provided with a slidable protective cover 39. This protective cover 39 has a forward edge 40 provided with a pair of spaced-apart blind slots 41 communicating therewith. These slots 41 have bottoms 42 which receive the camming bumps 28 as the device 12 is slidably removed from the docking station 10, thereby assuring that the protective cover 39 will be carried along with the device 12.

Figure 18:
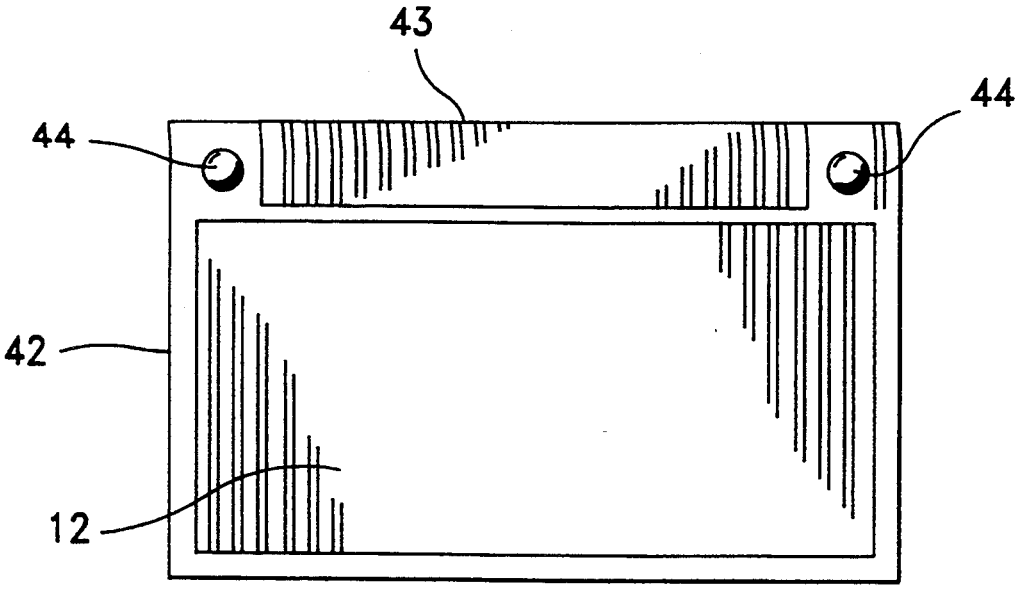
FIG. 18 is a top plan view of the device (such as a memory card) provided with a rectangular frame, the frame having the pair of camming bumps formed directly thereon.

With reference to FIG. 18, the device 12 is supported in a rectangular frame 42 having a forward portion 43 provided with respective cam bumps 44.

Figure 19:
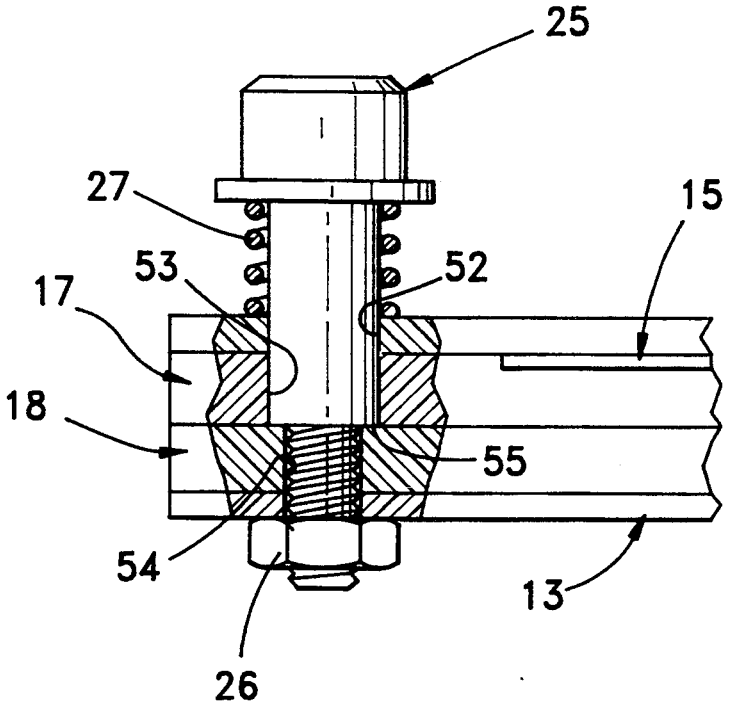
FIG. 19 is a cross-sectional view taken along the lines 19—19 of FIG. 3, and showing one embodiment of a suitable fastening means for the docking connector.
Figure 20:
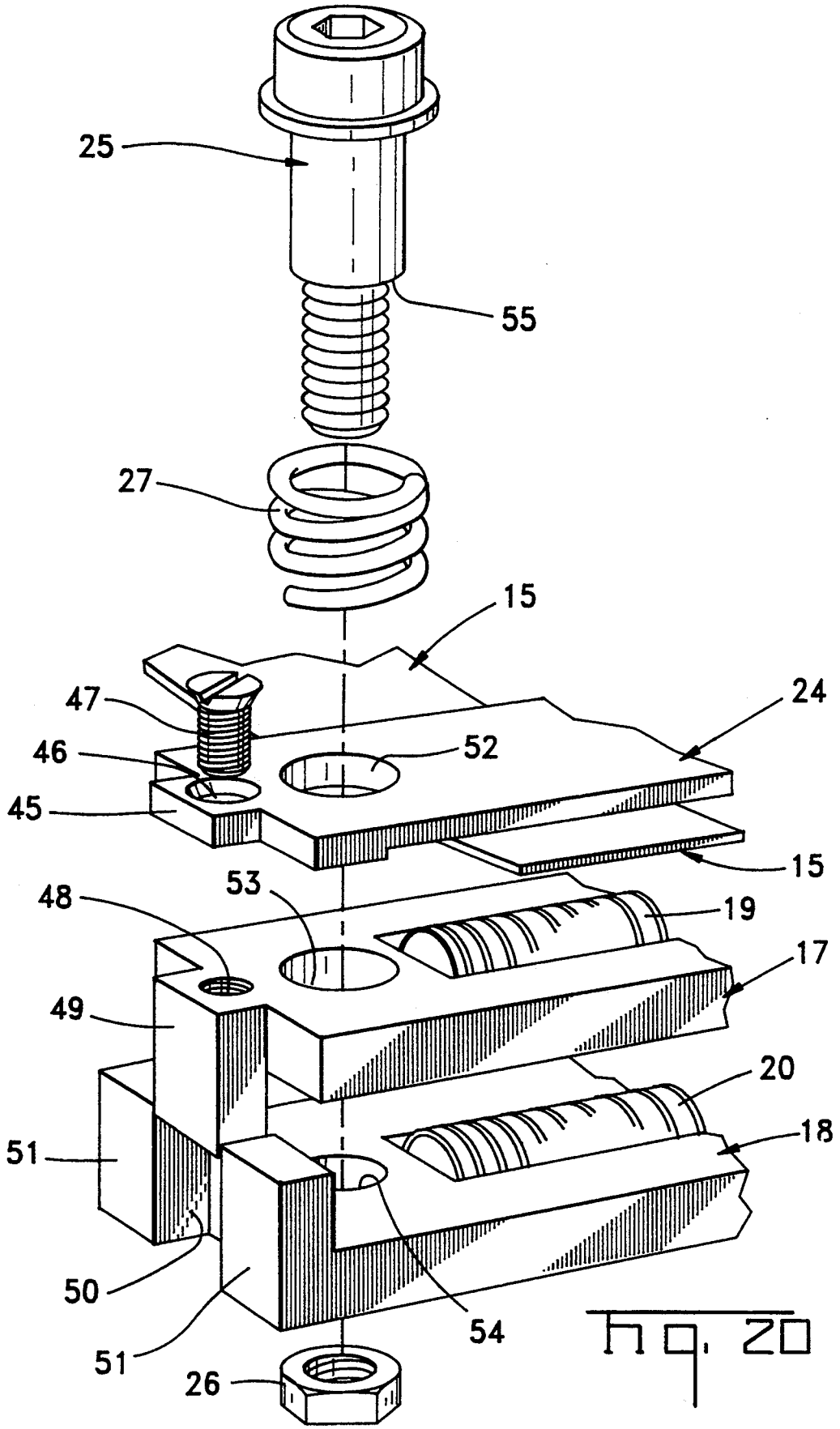
FIG. 20 is a perspective view of the components of FIG. 19 in their exploded relationship.

With reference to FIGS. 19 and 20, the stiffener 24 has laterally-extending ears, one of which, 45, is shown in FIG. 20, and is provided with a hole 46 for a screw 47. This screw 47 is received in a tapped recess 48 in a tongue 49 in the upper connector housing 17. This tongue 49 is received in a slot 50 formed between laterally-extending legs 51 formed on the lower connector housing 18, thereby accurately aligning the connector housings 17 and 18. The bolt 25 passes through mounting holes 52, 53 and 54 in the stiffener 24, the upper connector housing 17, and the lower connector housing 18, respectively. The bolt 25 has a shoulder 55 engaging the top of the lower connector housing 18. This lower connector housing 18 is suitably secured to the printed circuit board 13.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A docking connector comprising, in combination, a flexible etched circuit having at least one circuit element thereon, an electrical member having at least one contact pad thereon, a pair of connector housings disposed between the flexible etched circuit and the electrical member and including a first connector housing and a second connector housing, a first compressible electrical connector in the first connector housing and engaging the circuit element on the flexible etched circuit, a second compressible electrical connector in the second connector housing and engaging the first compressible electrical connector and the contact pad on the electrical member, respectively, a device slidably inserted between the connector housings and having at least one circuit element thereon, thereby establishing a circuit interface having make and break and tap functions, and camming means between the device and at least one of the connector housings, thereby separating the connector housings and hence the respective compressible electrical connectors therein relative to each other and in a direction transverse to the direction in which the device is slidably inserted, and thereby assuring that the device is slidably inserted with a zero insertion force on the circuit interface.

2. The combination of claim 1, wherein the flexible etched circuit is backed up by a stiffener, and wherein spring means provides a resilient bias on the stiffener and hence the first and second connector housings in opposition to the force of the camming means.

3. The combination of claim 2, wherein fastening means is provided for the docking connector, the fastening means including at least one bolt having a head, and wherein the spring means comprises a coil spring piloted on the bolt and disposed between the stiffener and the head of the bolt.

4. The combination of claim 1, wherein the electrical member comprises a printed circuit board.

5. The combination of claim 1, wherein the camming means comprises at least one camming bump on the device and extending both above and below the device, the connector housings having respective front faces provided with communicating inwardly-tapered surfaces engaging the camming bump on the device, and the connector housings further having respective communicating pockets to receive the camming bump on the device, such that the device is slidably inserted into the docking connector and received therein with a detented snap action.

6. The combination of claim 5, wherein the device has a forward edge, and wherein the camming bump comprises a slip-on cam secured to the forward edge of the device and protruding forwardly therefrom, the slip-on cam having a dovetailed connection with the device, and the slip-on cam further having a forward externally-tapered surface engaging the inwardly-tapered surfaces on the respective front faces of the connector housings.

7. The combination of claim 5, having a pair of spaced-apart camming bumps carried by the device and engaging a pair of spaced-apart inwardly-tapered surfaces on the connector housings, respectively, and the connector housings having a spaced-apart pair of communicating pockets receiving the respective camming bumps.

8. The combination of claim 7, wherein the device is provided with a frame having a forward portion, and wherein the camming bumps are formed on the forward portion of the frame.

9. The combination of claim 1, wherein a protective cover is slidably carried by the device, the protective cover including a forward edge provided with a pair of blind slots, each of which has a bottom, such that as the device is further inserted into the docking connector, the forward edge of the cover engages the docking connector, and such that as the device is withdrawn from the docking connector, the camming bumps on the device ride within the respective blind slots in the protective cover and engage the respective bottoms thereof, thereby returning the protective cover to its original position on the device.

10. In a docking connector, the combination of a printed circuit board, a lower housing secured on top of the printed circuit board, an upper housing on top of the lower housing, means for accurately aligning the upper and lower housings laterally with respect to each other, a stiffener on top of the upper housing, a flexible etched circuit sandwiched between the stiffener and the top of the upper housing, a flexible electrical connector in each of the upper and lower housings and providing a circuit interface with the flexible etched circuit and the printed circuit board, respectively, fastening means passing through the stiffener, the upper and lower housings, and the printed circuit board, and a device inserted between the upper and lower housings to provide a make and break and tap function with the circuit interface, respectively.

11. The combination of claim 10, further including camming means between the device and the upper and lower housings, thereby separating the housings as the device is slidably inserted therebetween, and thereby providing a zero insertion force for the circuit interface.

12. The combination of claim 11, wherein the fastening means comprises at least one bolt having a shoulder engaging the top of the lower housing, the bolt having a portion extending below the printed circuit board, and a nut on the extending portion of the bolt.

13. The combination of claim 12, wherein the bolt has a head, and wherein a coil spring is piloted on the bolt and is disposed between the stiffener and the head of the bolt, thereby exerting a resilient bias on the stiffener and hence the upper housing in opposition to the camming means.

14. The combination of claim 10, wherein the aligning means comprises a tongue on the upper housing, and the lower housing having a groove for slidably receiving the tongue.

* * * * *